United States Patent [19]

Reilly et al.

[11] Patent Number: 4,614,612

[45] Date of Patent: Sep. 30, 1986

[54] LIQUID DETERGENT COMPOSITION

[75] Inventors: John T. Reilly, Wirral; Roy B. Hobson, Clwyd; Gordon J. Abdey, Wirral, all of England

[73] Assignee: Lever Brothers Company, New York, N.Y.

[21] Appl. No.: 494,677

[22] Filed: May 16, 1983

Related U.S. Application Data

[63] Continuation of Ser. No. 174,945, Aug. 4, 1980, abandoned, which is a continuation of Ser. No. 972,153, Dec. 21, 1978, abandoned.

[30] Foreign Application Priority Data

Dec. 22, 1977 [GB] United Kingdom ..... 55472/77

[51] Int. Cl.[4] ..... C11D 1/22; C11D 1/29; C11D 1/37; C11D 3/382

[52] U.S. Cl. ..... 252/541; 252/89.1; 252/132; 252/153; 252/173; 252/544; 252/547; 252/551; 252/553; 252/558; 252/559; 252/DIG. 10; 252/DIG. 14

[58] Field of Search ..... 252/100, 132, 136, 142, 252/143, 153, 173, 174.21, 534, 540, 545, 553, 558, 559, DIG. 14, 89.1

[56] References Cited

U.S. PATENT DOCUMENTS

| | | | |
|---|---|---|---|
| 1,074,491 | 9/1913 | Colvin | 252/125 |
| 1,488,035 | 3/1924 | Cruver | 8/525 |
| 1,811,809 | 6/1931 | Schwarzkopf | 424/70 |
| 1,890,214 | 6/1932 | Churchill | 252/142 |
| 2,303,932 | 12/1942 | Guild | 252/142 |
| 2,674,580 | 4/1954 | Henkin | 252/117 |
| 2,770,599 | 11/1956 | Henkin | 252/117 |
| 3,083,166 | 3/1963 | Harding | 252/142 |
| 3,113,104 | 12/1963 | Bersworth | 252/1 |
| 3,141,821 | 7/1964 | Compeau | 424/65 |
| 3,248,333 | 4/1966 | O'Roark | 252/144 |
| 3,332,876 | 7/1967 | Walker | 252/545 |
| 3,389,178 | 6/1968 | Fields | 252/547 X |
| 3,650,968 | 3/1972 | Hoffman | 252/142 |
| 4,079,020 | 3/1978 | Mills | 252/547 |

FOREIGN PATENT DOCUMENTS

| | | |
|---|---|---|
| 287889 | of 0000 | Australia . |
| 665002 | of 0000 | Belgium . |
| 583207 | of 0000 | Belgium . |
| 2434063A | of 0000 | Fed. Rep. of Germany . |
| 1041510 | of 0000 | France . |
| 1300699 | of 0000 | France . |
| 378443 | of 0000 | Switzerland . |
| 459039 | of 0000 | United Kingdom . |
| 18247 | of 0000 | United Kingdom . |
| 1224564 | 3/1971 | United Kingdom . |
| 1339069 | 11/1973 | United Kingdom . |
| 1375639 | 11/1974 | United Kingdom . |
| 1478014 | 6/1977 | United Kingdom . |

OTHER PUBLICATIONS

DAS Grosse Kochbuch Unserer Zeit (1967).
Soap & Chemical Specialties, Aug. 1969, p. 137.
Norda Briefs No. 461 (Oct. 1974).

*Primary Examiner*—Dennis L. Albrecht
*Attorney, Agent, or Firm*—James J. Farrell

[57] ABSTRACT

An aqueous liquid detergent composition especially adapted for dishwashing, comprising 5–60% by weight of an organic synthetic surfactant system of at least two surfactants, and 5–50% by weight of a citrus juice, said organic synthetic surfactant system consisting of 1. from about 30–90 parts by weight of the surfactant system of a Ca-sensitive first surfactant selected from the group consisting of water-soluble $C_{8-16}$ alkyl benzene sulphonates; alkane sulphonates having 8–20 carbon atoms; olefin sulphonates having from 8–20 carbon atoms; di-$C_{8-20}$-alkyl sulphosuccinates; di-$C_{6-12}$-alkyl phenol sulphosuccinates; primary and secondary alkyl sulphates having 8–20 carbon atoms; $C_{8-20}$ alkyl polyethoxy sulphates having 1–25 ethoxy groups and mixtures thereof, and
2. from about 70–10 parts by weight of said system of a less Ca-sensitive second surfactant selected from the group consisting of water-soluble nonionic condensation products obtained by condensing from 5–30 moles of an alkylene oxide, preferably ethylene or propylene oxide with one mole of an organic hydrophobic compound, aliphatic or alkyl aromatic in nature, having 8 to 24 carbon atoms and at least one reactive hydrogen atom, particularly a reactive hydroxyl, amino, amido or carboxyl group; $C_{8-20}$-alkylsulphobetaines; amine oxides containing one long chain alkyl moiety of from 10–28 carbon atoms and two moieties which can be either alkyl radicals or hydroxyalkyl radicals having from 1–4 carbon atoms; $C_{8-20}$-alkyl-polyethoxy sulphates having from 1–25 ethoxy groups, and mixtures thereof, said surfactants of group (1) and the ion-active surfactants of group (2) being present in the form of their alkalimetal salts, ammonium salts, lower alkanol amine salts, lower alkylamine salts or mixtures thereof.

The composition is an effective liquid dishwashing composition with improved cleaning performance on difficult soils.

1 Claim, No Drawings

LIQUID DETERGENT COMPOSITION

This is a continuation of Ser. No. 174,945, filed Aug. 4, 1980, now abandoned which is a continuation of Ser. No. 972,153 filed Dec. 21, 1978 and now abandoned.

This invention relates to a liquid detergent composition with improved cleaning performance. More particularly the invention relates to an improved liquid detergent composition which is especially suitable for the manual cleaning of dishes, glasses, kitchen utensils, cutlery and the like. The liquid detergent composition of the invention contains juice of a citrusfruit, such as lemon juice.

Liquid detergent compositions containing lemon juice are known in the art. U.S. Pat. No. 3,650,968 describes cleaning compositions for removing fish odours comprising 30–80% by weight of water, 0.1–35% by weight of detergent and 0.1–15% by weight of citrus (lemon) juice. These liquid detergent compositions, however, have very poor dishwashing properties and cannot therefore be used satisfactorily for the cleaning of dishes, glasses, kitchen utensils, cutlery and the like.

It is an object of the present invention to provide an effective liquid dishwashing detergent composition which is moreover particularly effective against difficult soils.

It is a further object of the present invention to provide a method for the removal of difficult soils from dishes, pots and pans and other kitchen utensils.

By "difficult soils" is meant here the difficult end of the dishwashing spectrum, such as baked-on proteins and starch soils.

These and other objects of the invention, which will be apparent hereinafter, can be achieved by combining an organic synthetic surfactant system of at least two surfactants as defined below with a citrus juice at a level of from 5% by weight based on the total composition. Any juice of a citrus fruit belonging to the general class of citrus fruits can be used, such as: sweet oranges (citrus sinensis); sour or bitter oranges (citrus auranticum); mandarins (citrus reticulata); grapefruits (citrus paradisi); pumelos (citrus grandis); lemons (citrus limon); limes (citrus aurantifolia); citrons (citrus medica); papeda (citrus hystrix) and trifoliate oranges (citrus trifoliata), though lemon juice in view of its established consumer's acceptance will be preferred in the invention.

Unless otherwise indicated the percentages of fruit juices given in this specification refer to fruit juices of single strength. The term "single strength" is used here to indicate the average strength of fruit juice squeezed out from fruit. If concentrated juices are used, these will be indicated by designating the strength factor, e.g. "4× concentrate".

The compositions of the present invention are therefore especially designed for general use in conventional dishwashing, which can be used in the concentrated aqueous form or in the conventional highly dilute dishwashing operation, producing a good cleaning effect combined with a consumer-acceptable foam level and foam stability.

Accordingly the liquid detergent composition of the invention comprises from about 5–60% by weight of an organic synthetic surfactant system of at least two surfactants as defined below, and at least 5% by weight of a citrus juice.

The organic synthetic surfactant system consists of 1. from about 30–90 parts by weight of the surfactant system of a Ca-sensitive first surfactant selected from the group consisting of water-soluble $C_8$–$C_{16}$-alkyl benzene sulphonates, alkane sulphonates having 8–20 carbon atoms, olefin sulphonates having from 8–20 carbon atoms, di-$C_{8-20}$-alkyl sulpho-succinates, di-$C_{6-12}$-alkyl phenol sulphosuccinates, primary and secondary alkyl sulphates having 8–20 carbon atoms, $C_{8-20}$-alkyl polyethoxy sulphates having 1–25 ethoxy groups, and mixtures thereof, and
2. from about 70–10 parts by weight of said system of a less Ca-sensitive second surfactant selected from the group consisting of water-soluble nonionic condensation products obtained by condensing from 5–30 moles of an alkylene oxide, preferably ethylene or propylene oxide, with one mole of an organic hydrophobic compound, aliphatic or alkyl aromatic in nature, having 8–24 carbon atoms and at least one reactive hydrogen atom, particularly a reactive hydroxyl, amino, amido or carboxyl group; $C_{8-20}$-alkyl sulphobetaines; amine oxides containing one long chain alkyl moiety of from 10–28 carbon atoms and two moieties which can be either alkyl radicals or hydroxyalkyl radicals having from 1 to 4 carbon atoms; $C_{8-20}$-alkyl polyethoxy sulphates having 1–25 ethylene oxide groups, and mixtures thereof, said surfactants (1) and the ion-active surfactants of group (2) being present in the form of their alkali metal salts, ammonium salts, lower alkanolamine salts, lower alkylamine salts or mixtures thereof.

Examples of nonionic water-soluble condensation products obtained by condensing 5–30 moles of an alkylene oxide with one mole of an organic hydrophobic compound are:

a. the condensates of the ethylene oxide with aliphatic straight chain or branched chain, primary or secondary alcohols of more than 8 carbon atoms such as those derived from tallow or coconut fatty acids, containing 5–20 ethylene oxide groups, and branched chained $C_{11}$–$C_{15}$ alcohols condensed with 5–20 ethylene oxide groups.
b. the condensates of ethylene oxide with alkylphenols, in which the phenols may be mono- or polyalkylated and the total number of carbon atoms in the side chain or chains is from 5 to 18. Specific examples are condensates of one mole nonyl phenol with 8 to 15 moles of ethylene oxide.
c. the condensates of ethylene oxide with fatty acid esters, preferably mono-fatty acid esters of the sugar alcohols, sorbitol and manitol.
d. polyethenoxyesters obtained by reacting ethylene oxide with carboxylic acids, the latter being natural fatty acids or synthetic fatty acids made from oxidised paraffin wax having from 8–20 carbon atoms or alkylbenzoic or naphthenic acids having from 5–18 carbon atoms in the alkyl chain.
e. the condensation products of fatty acyl alkanolamides of the type $C_{7-17}$alkyl-CO-$NHC_2H_4OH$, $C_{7-17}$alkyl-CO-$N(C_2H_4OH)_2$ with ethylene oxide.
f. the condensation products of $C_{8-18}$alkyl-, $C_{8-18}$alkenyl- and $C_{8-18}$alkylaryl amines with ethylene oxide. A specific example is the condensation product of one mole of a dodecylamine with 9–12 moles of ethylene oxide.

Specific examples of amine oxides are dimethyl dodecyl amine oxide, diethyl tetradecyl amine oxide, bis-(2-hydroxyethyl)-dodecyl amine oxide, and dimethyl-2-hydroxydodecyl amine oxide.

It has been discovered that the above defined surfactant system can be utilised effectively in combination with citrus juice, particularly lemon juice, in the above stated proportions, to provide the desirable combined effect of good detergency, good foam behavior and enhanced performance on difficult soils, particularly baked-on or dried-on proteins or starchy soils, over a wide pH range from practically acid pH to alkaline pH, e.g. from 4–10. A preferred pH range of the composition of the invention is from about 5.5 to 9, particuarly from 6–8.5, more particularly from 7–8.5.

Any combination of the above-described first and second surfactants can be used to form the organic synthetic surfactant system in the composition of the invention.

Typical examples of surfactant systems are alkyl benzene sulphonate/alkyl polyethoxy sulphate mixtures; alkyl benzene sulphonate/alkyl polyethoxy sulphate/-nonionic mixtures; alkyl sulphate/alkyl benzene sulphonate/alkyl polyethoxy sulphate mixtures and alkyl sulphate/alkyl polyethoxy sulphate/amine oxide mixtures.

As explained above, any type of citrus juice at a level of from 5% by weight can be used in the present invention, lemon, lime, orange and grapefruit juices being representative of the general class. The minimum amount of 5% by weight of citrus juice is taken since at lower levels the effect is insignificant to practically zero. Although any proportion above 5% of citrus juice as practically possible can in principle be used, it was found that high levels are not necessary to achieve the desired benefit. Besides, as there is a clear fall-off in the increase in performance improvements with increasing juice content above 10%, and a quick fall-off especially in the higher percentage region, the use of too high levels of juice will not justify the extra high expenses incurred. Advantageously 50%, preferably 25%, can be taken as a convenient practical upper level of single strength citrus juice in the composition of the invention, as at concentrations above these percentages citrus juice provides no further advantages that would compensate the high costs of extra citrus juice.

A citrus juice level most advantageously used in the liquid detergent composition of the invention is from 5% to about 10% by weight.

Accordingly the invention provides an aqueous liquid detergent composition especially adapted for dishwashing and having improved cleaning performance particularly on difficult soils, comprising 5–60% by weight of an organic synthetic surfactant system consisting of at least two surfactants as defined hereinbefore, and 5–50% weight of a citrus juice.

Citrus juices are availble on the market. They are generally presented as either single strength juices or as concentrates of various strengths, i.e from 2x concentrates up to 10x concentrates. Lemon juice contains a number of different classes of chemical compounds including acids, sugars, amino acids, oils and trace elements. Analytical data on citrus juices can be found in the following literature references:

a. "Chemical Constituents of Citrus Fruits", Supp. 2 (1970) by Kefford and Chandler;
2. "Biochemistry of Fruits and their Products", Vol. 1 (1970) Ed. A. C. Hulme.

Within each class there are several different constituents each separately capable of being determined analytically. The main acid in citrus juice is citric acid, which is present at a level of about 5–6% by weight.

It is now known exactly which of the constituents present in citrus juice are responsible for improving the cleaning effect, but it is believed that a synergistic effect is produced by the combination of one or more constituents present in citrus juice and the active system used in the composition of the invention.

In addition to the above-described essential ingredients the liquid detergent composition of the invention can optionally contain other non-essential materials. Such optional ingredients include additional surfactants other than those specified as first and second surfactants of the organic synthetic surfactant system; builder salts which can be added to promote the cleaning and soil-removal efficiency of the surfactants of the composition, e.g. phosphates, polyphosphates, phosphonates, carbonates, polyacetates and polycarboxylates; lather promoting agents, such as coconut fatty acid diethanol amide; hydrotropes and solubilising agents, such as the lower alkanols containing 2–4 carbon atoms, especially ethanol, urea, sodium or potassium toluene sulphonate and sodium or potassium xylene sulphonate, which are generally added to promote phase stability especially of compositions with high concentrations of surfactants; preservatives; perfume and colouring agents. Furthermore, as desired, acid or alkaline substances for pH adjustment and also scouring agents may be incorporated in the detergent composition of the invention.

Preferred compositions are those which contain 10–50% by weight of the above-described organic synthetic surfactant system, 5–25% by weight of lemin juice and about 15–75% by weight of water. Particularly preferred are those having an active detergent content of more than 35% by weight.

The invention will now be illustrated by the following Examples:

EXAMPLES I–III

The following compositions were prepared:

| | I | II | III | A | B |
|---|---|---|---|---|---|
| Composition | % by weight | | | | |
| sodium dodecyl benzene sulphonate | 29.0 | 29.0 | 29.0 | 29.0 | 29.0 |
| sodium lauryl-(ethoxy)$_3$-sulphate | 14.0 | 14.0 | 14.0 | 14.0 | 14.0 |
| sodium citrate | — | — | — | — | 1.0 |
| lemon juice (4 × concentrate) | 1.25 | 2.5 | 5.0 | 0.25 | 0.25 |
| ethanol | 5.5 | 5.5 | 5.5 | 8.0 | 7.0 |
| urea | 5.5 | 5.5 | 5.5 | 7.5 | 8.0 |
| water + preservatives | 44.75 | 43.5 | 41.0 | 41.25 | 40.75 |

To determine the relative ease of cleaning of baked-on soils from substrates after soaking, the following half-tile comparison test method was used:

Soiled substrates, in the form of square enamel tiles (10×10 cm) are immersed in solutions of the test products (1 liter) at 0.15% concentrations. The solution is at 45° C. at the start of the test and is reheated when it drops to 40° C. (use a small immersion coil). The tiles are checked for the first indications that the soil on one of them has softened and then all are removed from the test solution and cleaned (immersion time varies between 5–50 mins). Cleaning is carried out for 30 seconds using a Brillo Swish sponge dipped in the appropriate test solution.

THE SOIL AND SOILING METHOD

The tests were carried out using Fruit Pie Filling (Cherry and Apricot) and a mixture of flour and fruit pie filling (1:4). The pie filling is finely mushed by pressing it through a 240 micron sieve and a fine paste is produced from the flour/pie filling mixture.

The soil is applied to the substrate by screen printing, using two passes. The soil is then baked in the centre of a large oven (Gallenkamp Oven Model OV330) for 4 minutes. Temperature should be 250° C. before putting the soiled substrates into the oven and speed in putting them into the oven is desirable to avoid the temperature dropping below 220° C.

RESULTS

These are set out fully in Table 1 below. Assessment was made by a technician panel rating the degree of soil removal on the following basis:

0=completely clean
1=still slightly soiled
2=moderately soiled
3=considerably soiled
4=no visible cleaning.

The ratings were averaged from 8 results for each product and control. Product A was used as control.

TABLE 1

| | Average Rating | | Difference (control-sample) | |
|---|---|---|---|---|
| Product | in 5° H water | in 26° H water | in 5° H water | in 26° H water |
| I | 2.13 | 2.93 | +0.81 | +0.81 |
| control (A) | 2.94 | 3.74 | | |
| II | 1.25 | 3.31 | +0.44 | +0.32 |
| control (A) | 1.69 | 3.63 | | |
| III | 1.00 | 2.18 | +0.88 | +0.44 |
| control (A) | 1.88 | 2.62 | | |
| B | 0.75 | 2.62 | −0.12 | +0.37 |
| control (A) | 0.63 | 2.25 | | |

From the above results it is clear that the lemon juice compositions I, II and III of the invention are superior to compositions A and B outside the invention.

EXAMPLE IV

The influence of pH was investigated from assessing the performance of the following liquid composition in a soaking test.

| Composition | |
|---|---|
| sodium dodecyl benzene sulphonate | 29.0% |
| $C_{12}$ alkyl ether sulphate containing 3 ethylene oxide | 14.0% |
| lemon juice | 10.0% |
| ethanol | 5.5% |
| urea | 5.5% |
| water + preservatives | 36.0% |

Comparisons were carried out by using the standard (10×10 cm) enamel tiles soiled with Apricot pie filling/flour and baked as in Examples I–III. Half tile comparisons in water of 11.3° German Hardness were carried out at 45° C.

Test products were tested in a random manner and all tests were duplicated.

pH Adjustments were carried out at 45° C. using dilute sulphuric acid (0.1M) and dilute sodium hydroxide (0.1M) solutions and measurement of the pH at the end of each test was also made.

A product of the above nominal composition without lemon juice was used as control.

Assessment was made by a technician panel to assess the degree of soil remaining on each half tile using the following ratings:

0=completely clean
1=still slightly soiled
2=moderately soiled
3=considerably soiled
4=no visible cleaning.

These ratings have been averaged (6 results for each test product and control at each pH value) and a soil difference between the control and the test product calculated.

TABLE I

Results of soaking test - a comparison of product with and without 10% lemon juice.

| pH | Product | Ratings | | | | | | Average | Difference control-sample |
|---|---|---|---|---|---|---|---|---|---|
| 5.5 | lemon | 1.5 | 2.5 | 1. | 0.5 | 1. | 0.5 | 1.17 | +0.75 |
| | control | 2.5 | 3. | 1.5 | 1.5 | 2. | 1. | 1.92 | |
| 7.0 | lemon | 3. | 3.5 | 2.5 | 0 | 0 | 0 | 1.5 | +0.67 |
| | control | 3.5 | 4. | 3. | 0.5 | 1. | 0.5 | 2.17 | |
| 8.5 | lemon | 0.5 | 0.5 | 0.5 | 0.5 | 1. | 0.5 | 0.58 | +1.42 |
| | control | 1.5 | 2. | 1. | 2.5 | 3. | 2. | 2.0 | |
| 10.0 | lemon | 1.5 | 2.5 | 1. | 1.5 | 2.5 | 1. | 1.67 | +0.50 |
| | control | 3. | 3. | 1.5 | 2. | 2.5 | 1. | 2.17 | |

The above Table shows that the composition of the invention shows a consistent superiority at pH 5.5, 7.0, 8.5 and 10.0, with results at pH 8.5 being particularly good.

EXAMPLE V

The following compositions were assessed:

| | % by weight | | | | | | |
|---|---|---|---|---|---|---|---|
| Composition | C | $V_1$ | $V_2$ | $V_3$ | $V_4$ | $V_5$ | $V_6$ |
| sodium dodecyl benzene sulphonate | 29.0 | 29.0 | 29.0 | 29.0 | 29.0 | 29.0 | 29.0 |
| lauryl-3-ethoxy-sulphate | 14.0 | 14.0 | 14.0 | 14.0 | 14.0 | 14.0 | 14.0 |
| lemon juice (4 × concentrate) | 0.25 | 1.25 | 2.5 | 3.75 | 5.0 | 6.25 | 12.5 |
| ethanol | 10.0 | 10.0 | 10.0 | 10.0 | 10.0 | 10.0 | 10.0 |
| urea | 10.0 | 10.0 | 10.0 | 10.0 | 10.0 | 10.0 | 10.0 |
| water + preservative | to 100.0 | to 100.0 | to 100.0 | to 100.0 | to 100.0 | to 100.0 | to 100.0 |
| nominal lemon juice level | 1 | 5 | 10 | 15 | 20 | 25 | 50 |

The method employed was as follows:

1. An egg soiling was prepared by carefully mixing dried egg powder and water in a ratio of 1:1.
2. A 5 cm strip of soil was screen-printed on to the centre of a 30×25 cm glass tile.
3. Tiles were baked for 30 mins at 200° C. Five assessments could then be carried out across each tile. At least two control assessments were carried out on each tile.
4. Five 5 cm wells were built across the tile using plasticine strips. 6 mls of solution (0.15%) were placed in a well. Using a J cloth covered head and a 1.5 kg weight, the number of rubs to clean the 5 cm strip of soil was recorded.
5. Results for the test solution were calculated as a percentage of the performance of the nearest control in the tile.

The results of the tests using water of 5°H are tabulated below:

| Composition | % Lemon juice | Average performance as % control |
|---|---|---|
| Control (C) | 1 | 100 |
| $V_1$ | 5 | 89 |
| $V_2$ | 10 | 61 |
| $V_3$ | 15 | 70 |
| $V_4$ | 20 | 73 |
| $V_5$ | 25 | 68 |
| $V_6$ | 50 | 60.5 |

The above results clearly show the superior performance of the compositions $V_1$ to $V_6$ of the invention, containing 5 to 50% lemon juice respectively, on cleaning baked-on egg, over the control.

EXAMPLE VI

The following compositions were compared in a standard plate washing test for their dishwashing performance as well as in a test to determine the relative ease of cleaning baked-on soils from substrates after soaking, using the test method as described in Examples I-III.

| Composition VI | Composition D |
|---|---|
| 10% sodium dodecylbenzene sulphonate | 15% Empilan ® LP 10* |
| 5% sodium lauryl (ethoxy)$_3$-sulphate | 30% glycerin |
| 5% lemon juice | 5% lemon juice |
| 2% urea | 2% urea |
| balance water | balance water |

*Empilan LP10 is a nonionic fatty amide condensate, comparable to Nopco 1179 of the Nopco Chemical Company. Empilan is a Registered Trade Mark of Marchon Products Ltd.

The standard plate washing tests were carried out using the following test conditions:

Product concentrations: 0.15% and 0.45%

Temperature of solution: 45° C.

Standard gravy soil at 5 g/plate: fat, starch, oleic and stearic acids.

The results are tabulated below:

TABLE 3

| Water hardness | Number of plates washed | | | |
|---|---|---|---|---|
| | 5° H | | 26° H | |
| Product concentration | 0.15% | 0.45% | 0.15% | 0.45% |
| Composition VI (pH 7) | 30 | 63 | 27 | 59 |
| Composition D (pH 5.8) | 3 | 7 | 2 | 4 |

Results of the test to determine the relative ease of cleaning baked-on soils from substrates. The ratings were arranged from 5 results for each product used at 0.75% concentrations.

TABLE 4

| Composition | Average rating in 5° H water | Average rating in 26° H water | Difference in 5° H water | Difference in 26° H water |
|---|---|---|---|---|
| VI (pH 7) | 0.2 | 2.4 | +0.5 | +0.0 |
| D (pH 5.8) | 0.7 | 2.4 | | |
| VI (pH 7) | 0.7 | 3.0 | +0.4 | +0.3 |
| D (pH 7) | 1.1 | 3.3 | | |
| VI (pH 7) | 2.4 | — | +0.3 | — |
| D (pH 5.8) | 2.7 | | | |
| VI (pH 7) | 1.5 | — | +0.6 | — |
| D (pH 7) | 2.1 | | | |

The above results clearly show the superior properties of composition VI of the invention over composition D of the art in both dishwashing and baked-on soil performance.

EXAMPLES VII-IX

The following liquid dishwashing formulations are within the scope of the invention:

| | % by weight |
|---|---|
| Composition VII | |
| sodium dodecyl benzene sulphonate | 16.0 |
| nonyl phenol-7 ethylene oxide | 7.0 |
| ethanol | 2.0 |
| urea | 4.0 |
| lemon juice | 8.0 |
| water + preservatives | to 100.00 |
| Composition VIII | |
| ammonium dodecyl benzene sulphonate | 32.0 |
| nonyl phenol-10 ethylene oxide | 8.0 |
| ethanol | 3.0 |
| urea | 3.0 |
| sodium xylene sulphonate | 9.0 |
| lemon juice | 7.5 |
| magnesium sulphate | 1.2 |
| water + preservatives | to 100.0 |
| Composition IX | |
| sodium lauryl (ethoxy)$_3$-sulphate | 24.0 |
| dimethyl dodecyl amine oxide | 5.0 |
| lemon juice | 10.0 |
| sodium citrate | 1.0 |
| urea | 3.0 |
| ethanol | 3.0 |
| water + preservatives | to 100.0 |

We claim:

1. An aqueous liquid detergent composition, especially adapted for dishwashing, having a pH of from 5.5 to 9 and comprising 5-25% by weight of a lemon juice and 5-60% by weight of an organic synthetic surfactant system consisting essentially of from 30-90% parts by weight of a water-soluble $C_{8-16}$ alkyl benzene sulfonate and from 70-10 parts by weight of $C_{8-20}$ alkylpolyethoxysulfate having about 3 ethoxy groups, both said sulfonate and said sulfate being present in the form of alkali metal salts, ammonium salts or mixtures thereof.

* * * * *